United States Patent [19]

Kikuchi et al.

[11] 4,456,824

[45] Jun. 26, 1984

[54] COPYING MACHINE

[75] Inventors: Yoshiki Kikuchi; Takashi Ohmori; Haruhiko Moriguchi; Hisao Nakajima, all of Kanagawa, Japan

[73] Assignee: Fuji Xerox Co., Ltd., Tokyo, Japan

[21] Appl. No.: 312,024

[22] Filed: Oct. 16, 1981

[30] Foreign Application Priority Data

Dec. 10, 1980 [JP] Japan ..... 55-174077

[51] Int. Cl.[3] ..... G03C 5/16

[52] U.S. Cl. ..... 250/318; 250/319

[58] Field of Search ..... 250/317.1, 318.1, 319.1; 355/14

[56] References Cited

U.S. PATENT DOCUMENTS 3,135,621 6/1964 Damm et al. ..... 250/319

3,251,994 5/1966 Russell ..... 250/318

3,379,878 4/1968 Limberger ..... 250/319

3,902,062 8/1975 Eichorn ..... 250/319

4,310,236 1/1982 Connin ..... 355/14 SH

FOREIGN PATENT DOCUMENTS 975804 11/1964 United Kingdom ..... 250/318

*Primary Examiner*—Bruce C. Anderson

*Attorney, Agent, or Firm*—Sughrue, Mion, Zinn, Macpeak and Seas

[57] ABSTRACT

A compact thermosensitive printing machine includes a paper supply guide extending obliquely into a housing to a printing roller at its lower end, and a discharge tray on top of the supply guide for receiving the copied paper face-up after it has passed around the printing roller.

8 Claims, 2 Drawing Figures

COPYING MACHINE

BACKGROUND OF THE INVENTION

The present invention relates to a transfer-type thermosensitive line printer.

Conventional line printers of this type are complex in structure and comparatively large in size, requiring considerable space for installation.

Furthermore, it has been customary for the power supply unit to adversely affect recording operation in a thermosensitive recording printer.

SUMMARY OF THE INVENTION

To eliminate the foregoing problems, a line printer according to the present invention includes a paper supply and a paper discharge mechanism and a recording or copying mechanism compactedly arranged in a housing, while a power supply unit and an electrical control circuit unit of the line printer are accommodated in a separate or another housing. With this arrangement, it is possible to do copying work on a desk. To this end, the paper supply and the paper discharge mechanism are positioned in an upper portion of the copying machine not only to minimize the space which the machine takes up on the desk, but also to provide convenience for repair. Further, according to the present invention, the power supply unit is housed in the separate housing that can be installed isolatedly, e.g., under the desk as such housing has nothing to do with copying operation. Therefore, copying operation can be effected without being adversely affected by the generated heat.

DETAILED DESCRIPTION OF THE INVENTION

Figures 1, 2:
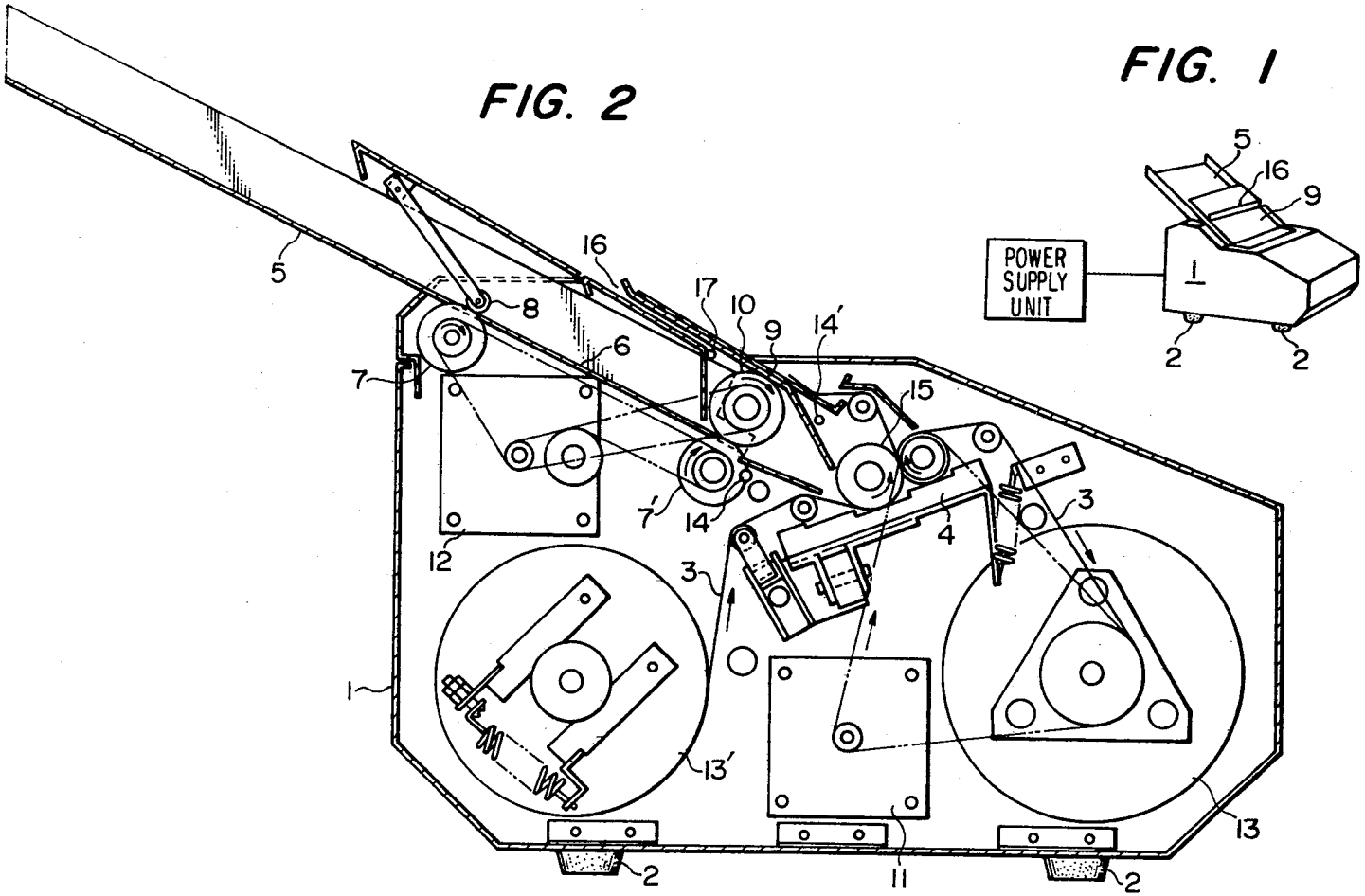
FIG. 1 is a perspective view of a copying machine according to the present invention.
FIG. 2 is a side elevational view with parts cut away to show the interior of the copying machine of FIG. 1.

The present invention will now be described with reference to the accompanying drawings. FIGS. 1 and 2 show the exterior and interior, respectively, of a housing in which there are accommodated a paper supply and a paper discharge mechanism, an ink donor sheet feeding mechanism, a recording mechanism, and an electrical control circuit for these mechanisms, all having a direct bearing on the copying operation. A power supply unit and an electrical control circuit unit, both accommodated in a separate housing, are known in the art and, therefore, will not be shown or described.

in FIG. 2, the reference numeral 1 designates a housing, 2 a set of rubber legs of the housing, 3 an ink donor sheet which is driven in the direction of the arrows. The reference numeral 4 designates a thermal head assembly to which video signals for each line on an original document to be copied are supplied from the exterior of the housing 1 as is known in the art. Designated at 5 is an automatic paper supply tray in which a stack of about 250 sheets of copying paper are placed, and at 6 is an automatic paper supply guide having on the underside thereof a pair of feed rollers, 7, 7′ rotatable at an equal speed for feeding sheets of copying paper one by one downwardly to the right. Another guide 16 (described below) is disposed at an intermediate portion of the guide 6 so that an extra sheet of copying paper can be inserted by hand from the guide 16 for extra copying while the automatic copying operation is being carried out. Designated at 9 is a tray into which copied sheets of paper are discharged. This is generally similar to the dual feed arrangement disclosed in copending applications Ser. No. 312,021 filed Oct. 16, 1981, Ser. No. 312,022, filed Oct. 16, 1981 and now issued as U.S. Pat. No. 4,424,964, and Ser. No. 312,023, filed Oct. 16, 1981 and now issued as U.S. Pat. No. 4,404,568, corresponding respectively to Japanese Application Nos. 55-170290 filed in Japan on Dec. 4, 1980, 55-170291 filed in Japan on Dec. 4, 1980, and 55-178918 filed in Japan on Dec. 19, 1980.

The operation of the copying machine is as follows: The stacked sheets of copying paper in the automatic paper supply tray 5 are fed downwardly from the lower side of the stack along the guide 6, and the leading edges of the sheets of recording paper come into contact with the feed roller 7 for further downward movement. Then, the sheets of copying paper pass between the feed roller 7 and a pinch roller 8, the pinch roller 8 being urged against the periphery of the feed roller 7 to limit the number of the sheets of copying paper to several. Such several sheets of copying paper go downwardly until the leading edges of the sheets of copying paper contact the periphery of the feed roller 7′ and then enter between the feed roller 7′ and a retard roller 10 rotatable in the same direction as the feed roller 7′ and held in contact therewith so that only a single sheet of copying paper can pass. The two feed rollers 7, 7′ are driven by a common motor 12 through a belt.

With continued downward advance of the leading edge of such a single sheet of copying paper, a register sensor 14 is energized and a predetermined time later the motor 11 is energized for feeding the ink donor sheet 3. Such a motor 11 is a step motor for winding the donor sheet 3 from a donor sheet supply reel 13′ around a takeup reel 13 via the thermal head assembly 4. Simultaneously therewith, the step motor 12 for feeding paper is de-energized. Thus preparations for a copying operation are completed.

As video signals from a host apparatus (not shown), for each line on the document to be copied, are supplied to the thermal head assembly 4, the donor sheet 3 is driven intermittently in a step-like manner for simultaneous line-by-line duplication. The paper to be copied, the paper copied, the ink donor sheet 3, and the donor sheet take-up reel 13 are driven by the common step motor 11.

The paper to be copied is sandwiched between the donor sheet 3 and the periphery of a feed roller 15 for printing or copying as it passes the thermal head assembly, and the copied sheet is then discharged into a discharge tray 9 such that the copied or printed side of the copied paper faces upwardly.

When duplication progresses line by line and the trailing edge of the copying paper moves past the register sensor 14, a signal is generated a short time later to terminate the generation of video signals, thus de-energizing the step motor 11. Since the register sensor 14 is spaced a distance from the thermal head, the various drive and recording devices or mechanisms are so controlled that their operation is delayed with respect to signals from the register sensor 14 which senses the leading and trailing edges of the paper to accommodate for the distance between the sensor and thermal head.

In the case where an extra copying operation is necessary during the automatic copying operation, an extra sheet of copying paper is inserted by hand through the guide 16 to interrupt the automatic copying mode of operation. As the leading edge of the extra sheet of copying paper is sensed by a sensor 17, rotation of the feed rollers, 7, 7' is stopped.

The extra sheet of copying paper than travels around the retard roller 10 to the thermal head assembly 4, at which time that leading edge of the extra sheet of copying paper is sensed by a sensor 14'. The retard roller 10 is driven by either the step motor 12 or a separate step motor (not shown). After arrival at the thermal head assembly 4, the extra sheet of copying paper takes the same course of travel as the normal sheet of copying paper for automatic copying operation. In such an extra copying operation, the leading edge of the extra sheet of copying paper is sensed by a sensor 14'.

With the copying machine thus constructed, the paper supply tray, the guide for extra copying paper, and the discharge tray are all arranged in the upper portion of the machine, resulting in a very compact machine having a width substantially equal to the width of copying paper. Further, this arrangement provides utmost convenience for handling and maintenance.

What is claimed is:

1. A transfer-type thermosensitive copying machine, comprising:

a housing;

a paper supply guide disposed in an upper portion of said housing and extending obliquely into said housing;

an ink donor sheet supply in said housing;

a thermal head assembly;

a printing roller disposed in said housing adjacent the lower end of said paper supply guide for receiving a sheet of paper from said supply guide and advancing said sheet of paper with a portion of an ink donor sheet in overlapping relation past said thermal head assembly, whereby said thermal head assembly selectively heats said paper through said donor sheet to transfer an image to one side of said sheet of paper; and a discharge tray disposed above said supply guide, said discharge tray receiving said sheet of paper with said one side facing upwardly after said image has been transferred.

2. A transfer-type thermosensitive copying machine as defined in claim 1, wherein said ink donor sheet supply comprises a supply roll beneath said supply guide for providing said ink donor sheet to said printing roller, said machine further comprising a take-up roll in said housing adjacent the axes of said supply, take-up and printing rollers being substantially parallel.

3. A transfer-type thermosensitive copying machine as defined in claim 1, wherein said supply guide contains paper which is automatically fed through a paper feeding means to said printing roller, said machine further comprising a slot formed between an upper surface of said supply guide and a lower surface of said discharge tray for manually inserting paper to be fed by said paper feeding means to said printing roller.

4. A transfer-type thermosensitive copying machine as defined in claim 1, further comprising a power supply unit for said copying machine disposed outside of said housing.

5. A transfer-type thermosensitive copying machine as defined in claim 2, wherein said ink donor sheet supply is conveyed from said supply roll to said take-up roll.

6. A transfer-type thermosensitive copying machine as defined in claim 1, further comprising an automatic paper supply tray disposed upstream of said paper supply guide, at least one feed roller disposed adjacent an underside of said paper supply guide for rotatably feeding said sheet of paper into said housing, and at least one pinch roller engaged with said at least one feed roller for feeding said sheet of paper.

7. A transfer-type thermosensitive copying machine as claimed in claim 6, further comprising a register sensor spaced from said thermal head assembly, said register sensor detecting a leading edge and a trailing edge of said sheet of paper as said sheet of paper is fed toward said thermal head assembly.

8. A transfer-type thermosensitive copying machine as claimed in claim 3, further comprising first and second register sensors spaced upstream from said thermal head assembly, said first register sensor sensing a leading and a trailing edge of sheets of paper received by said printing roller during an automatic copying operation, said second register sensor sensing a leading and a trailing edge of a sheet of paper manually inserted.

* * * * *